US006712582B1

(12) United States Patent
Lin et al.

(10) Patent No.: US 6,712,582 B1
(45) Date of Patent: Mar. 30, 2004

(54) CENTRIFUGAL FAN

(75) Inventors: Kuo-Cheng Lin, Taoyuan (TW); Bok-Haw Chang, Taoyuan (TW); Yu-Hung Huang, Taoyuan (TW)

(73) Assignee: Delta Electronics, Inc., Taoyuan (TW)

( * ) Notice: Subject to any disclaimer, the term of this patent is extended or adjusted under 35 U.S.C. 154(b) by 0 days.

(21) Appl. No.: 09/685,171

(22) Filed: Oct. 10, 2000

(51) Int. Cl.[7] ..... F04D 29/30; F04D 29/42

(52) U.S. Cl. ..... 415/206; 416/185; 416/223 B; 416/228; 416/235; 416/236 R

(58) Field of Search ..... 415/206, 207, 415/204, 211.1, 211.2; 416/185, 228, 235, 236 R, 237, 231 B, 223 B; 361/695, 696, 697

(56) References Cited

U.S. PATENT DOCUMENTS 847,585 A * 3/1907 Keith ..... 415/204
1,843,088 A * 1/1932 Minnard ..... 416/185
4,915,583 A * 4/1990 Vera et al. ..... 415/206
5,813,831 A * 9/1998 Matsunaga et al. ..... 415/206
5,979,541 A * 11/1999 Saito ..... 415/211.1
6,132,170 A * 10/2000 Horng ..... 415/204
6,179,561 B1 * 1/2001 Horng ..... 415/211.1

FOREIGN PATENT DOCUMENTS

GB 1282 A * 1/1891 ..... 415/207
JP 62-49700 A * 3/1987 ..... 415/211.1
WO WO-91/16544 A * 10/1991 ..... 415/204

* cited by examiner

*Primary Examiner*—Christopher Verdier
(74) *Attorney, Agent, or Firm*—William J. Sapone; Coleman Sudol Sapone, P.C.

(57) ABSTRACT

A centrifugal fan mounted in a laptop computer is assembled to include a casing having an intake opening and a horn-shaped outlet opening for increasing the air outflow, an impeller rotatably mounted in the casing with a reduced diameter and bared inner space for increasing the air capacity, and fan blades attached to the impeller, wherein each of fan blades is chipped at the rim for lowering the noise.

6 Claims, 7 Drawing Sheets

CENTRIFUGAL FAN

FIELD OF THE INVENTION

The present invention is related to a centrifugal fan, and more particularly to a centrifugal fan mounted in a laptop computer.

BACKGROUND OF THE INVENTION

In the modern era, the computer has become an indispensable tool for the people in their daily lives. The market of the laptop computer has rapidly expanded, together with the rise of the living standard and with the rise in living standard and with the demands of business. In recent years, the major manufacturers of laptop computers have dedicated money and manpower to research and development the laptop computer to increase. One bottleneck imposed on the development of the laptop computer is the issue of the heat dissipation. The key feature of the laptop computer is that the user can carry it and use it at anytime, usually by placing it on the lap for operation. If the laptop computer becomes overheated in such situations, it will not be usable and it will also be inconvenient to transport. Thus, the key feature of the laptop computer will be degraded.

Most of the current laptop computers use a fan to dissipate the heat generated in the laptop computer. The heat generated in a laptop computer is expelled out of the laptop computer by way of air convection. The fan expels the hot air out of the laptop computer and draws the cooling air into the laptop computer for lowering the temperature of the a laptop computer. Because the laptop computer must be small and thin for portability, it is somewhat difficult to incorporate a fan inside the laptop computer. If a common axial flow fan is adopted for dissipating the heat generated in a laptop computer, the airflow will not be smooth and the heat-dissipation efficiency will be low owing to the forced air convection induced by the axial flow fan. If a centrifugal fan is adopted to dissipate the heat generated in a laptop computer, the centrifugal fan is able to match the natural fundamentals of airflow and thus is feasible for dissipating the heat generated in a laptop computer.

Please refer to FIG. 1 which is the top view of the conventional centrifugal fan. An outlet opening is located on the side of the casing 11, which is not shown in the drawing. It can be seen from FIG. 1 that an impeller 13 facing the intake opening of the casing 11 (not shown) is rotatably mounted in the casing 11, and the fan blades 12 are attached to the impeller 13. The cooling air will flow into the intake opening by means of the rotation of the impeller 13 as well as the fan blades 12 and then blow off through the outlet opening on the side of the casing 11.

While the centrifugal fan is operating, noise will be inevitably generated as long as the air is flowing inside the centrifugal fan. Moreover, the faster the fan rotates, the louder noise will be generated. Therefore, if one desires to increase the rotating speed of the centrifugal fan in order to improve the heat-dissipating efficiency, the noise will become louder as well.

Accordingly, it is desirable to modify the centrifugal fan to solve the dilemma of whether to improve the heat-dissipating efficiency or to lower the noise.

SUMMARY OF THE INVENTION

It is an object of the present invention to provide a centrifugal fan with an increased air capacity and a lower noise.

It is another object of the present invention to provide a centrifugal fan with an improved heat-dissipating efficiency.

The centrifugal fan of the present invention includes a casing having an intake opening and a horn-shaped outlet opening for increasing the air outflow, an impeller rotatably mounted in the casing with a reduced diameter and bared inner space for increasing the air capacity, and fan blades attached to the impeller, wherein each of the fan blades is chipped at the rim for lowering the noise.

In accordance with the present invention, the fan blades are protruded from the rim of the impeller.

In accordance with the present invention, the gap of the fan blade is near the intake opening of the casing.

In accordance with the present invention, the inner periphery of the horn-shaped outlet opening will be reduced toward the inner space of the casing.

Now the foregoing and other features of the present invention may best be understood through the following descriptions with reference to the accompanying drawings, in which:

DETAILED DESCRIPTION OF THE PREFERRED EMBODIMENTS

Figure 1:
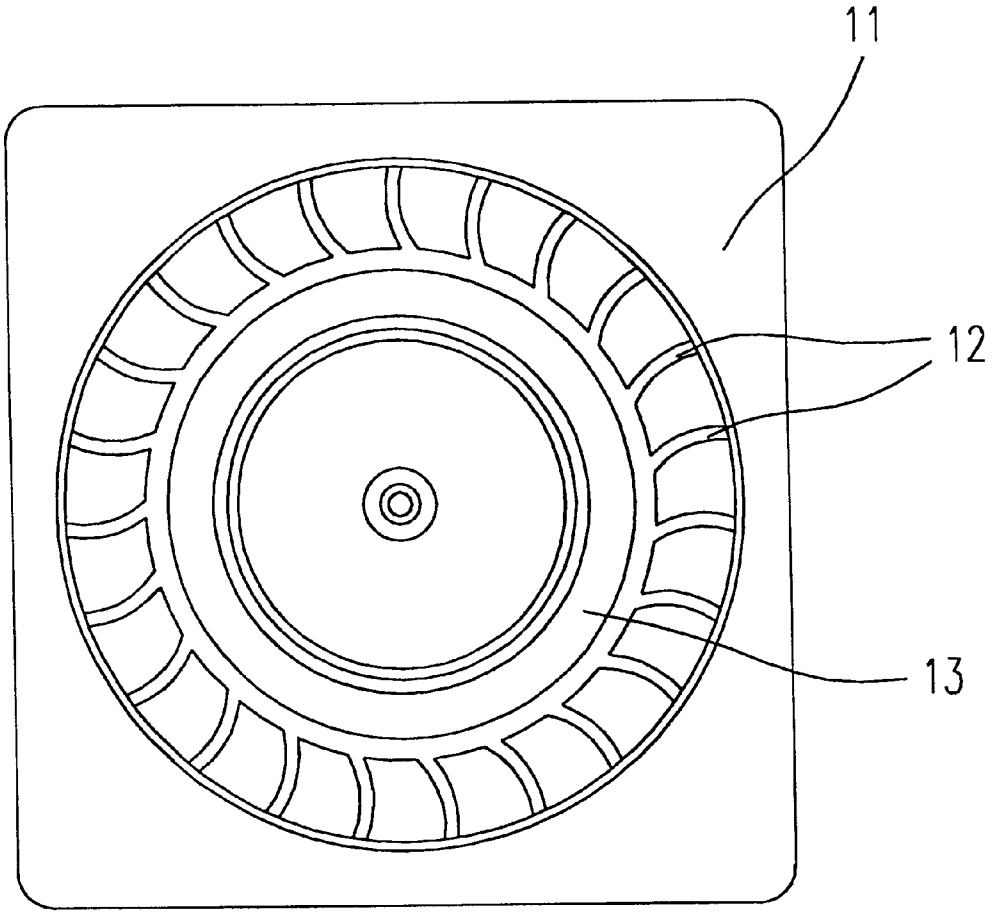
Fig. 1(PRIOR ART)
FIG. 1 is a top view of the conventional centrifugal fan.
Figure 2:
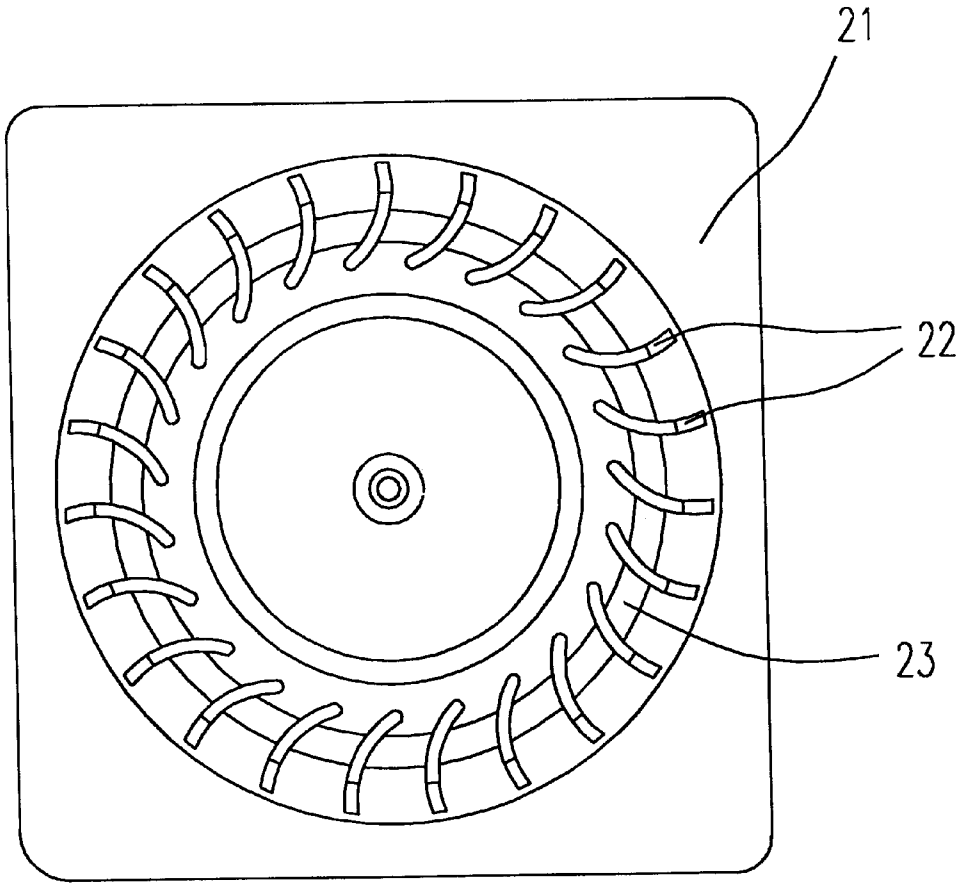
FIG. 2 is a top view of the centrifugal fan of the present invention.

FIG. 2 shows the top view of the centrifugal fan of the present invention. In comparison with the conventional centrifugal fan of FIG. 1, the centrifugal fan shown in FIG. 2 has an impeller rotatably mounted in a casing 21, the impeller including plural fan blades 22 arranged and disposed on a base 23, the fan blades protrude from the base of the attached impeller, and wherein each of said plural fan blades 22 has a gap at its' rim.

Figure 3:
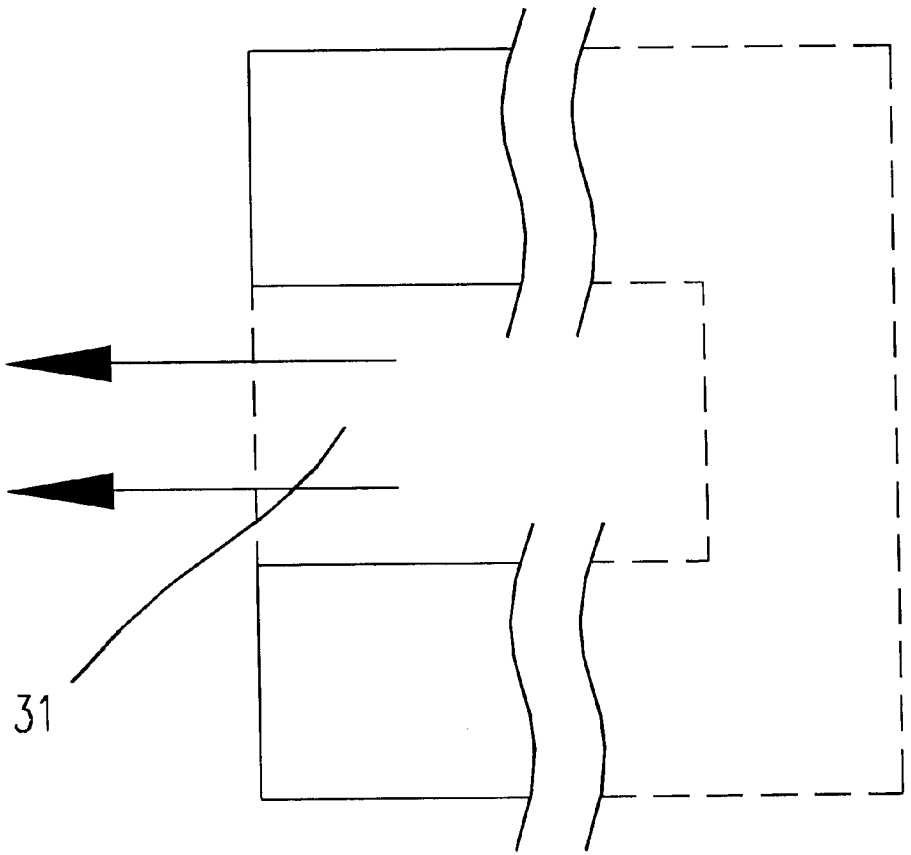
Fig. 3(PRIOR ART)
FIG. 3 is a cross-sectional view of the outlet opening of the conventional centrifugal fan.
Figure 4:
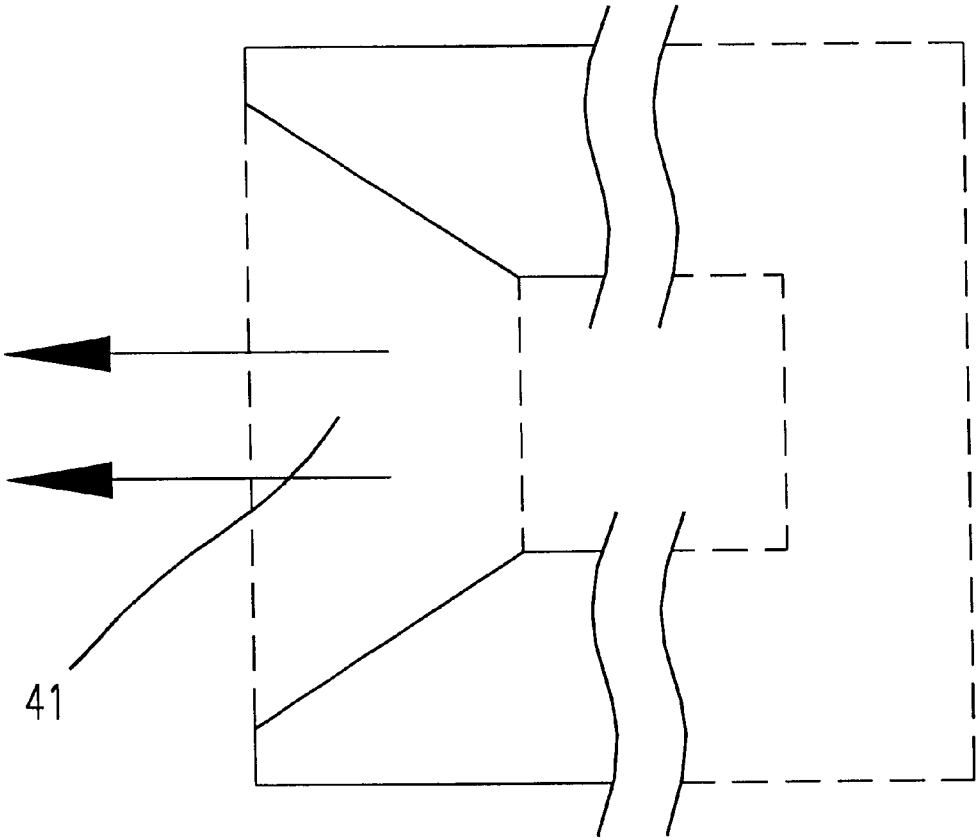
FIG. 4 is a cross-sectional view of the outlet opening of the centrifugal fan according to the present invention.

FIG. 3 is a cross-sectional view of the outlet opening of the conventional centrifugal fan, and FIG. 4 is a cross-sectional view of the outlet opening of the centrifugal fan according to the present invention. One characteristic of the centrifugal fan according to the present invention can be understood that the outlet opening 31 of the conventional centrifugal fan is a flat and rigid structure, but the outlet opening 41 of the centrifugal fan according to the present invention is a horn-shaped structure. Remarkably, the inner periphery of horn-shaped opening 41 will be reduced toward the inner space of the casing. Consequently, the airflow inside the centrifugal fan can be diffused rapidly and the air outflow is increased further.

Figure 5:
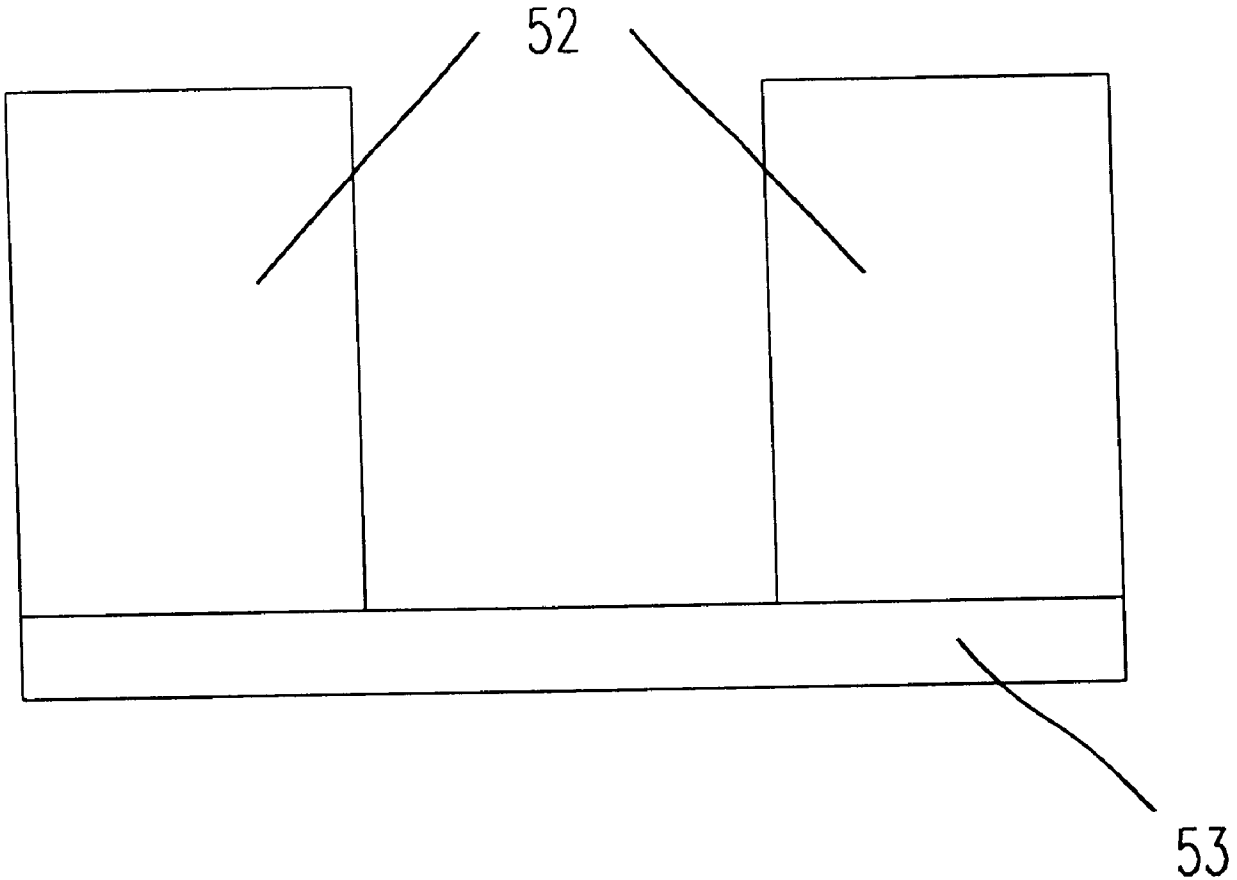
Fig. 5(PRIOR ART)
FIG. 5 is a cross-sectional view of the fan blades of the conventional centrifugal fan.
Figure 6:
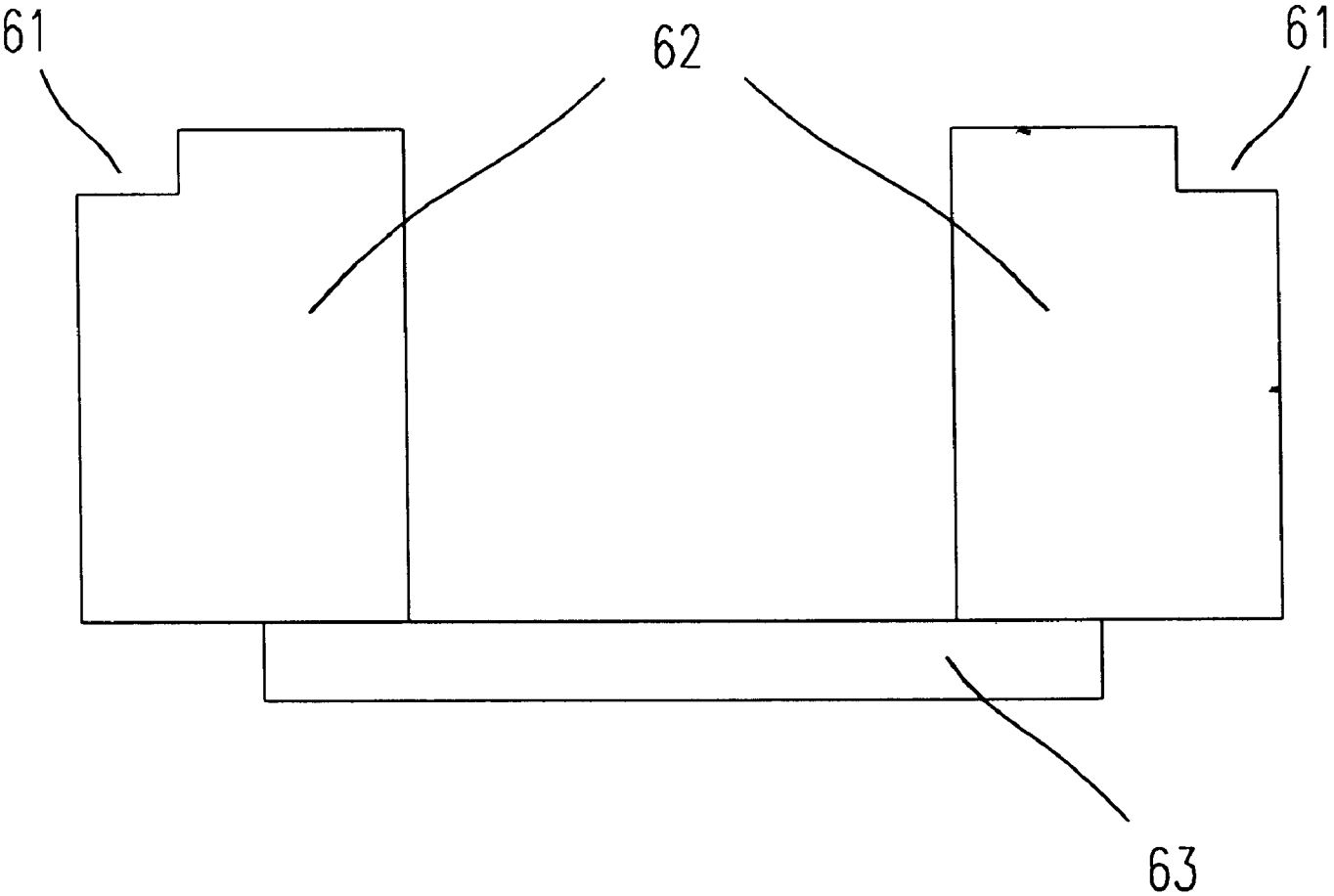
FIG. 6 is a cross-sectional view of the fan blades of the centrifugal fan according to present invention.

FIG. 5 and FIG. 6 are cross-sectional views of the fan blades of the prior art and the present invention, respectively. It can be known that the fan blades 52 of the conventional centrifugal fan are extended to the extent of the impeller 53.

To contrast FIG. 5 with FIG. 6, it is obvious that the fan blades 62 of the centrifugal fan according to the present invention are protruded from the rim of the impeller 63. Moreover, it is worthy to note that each of the fan blades 62 is chipped at the rim so as to have a gap 61 at the rim. While the fan blade 62 and the impeller 63 are mounted in the casing, the gap 61 of the chipped fan blade 62 is near the intake opening of the casing such that the noise will be lowered while the centrifugal fan is operating.

Figure 7:
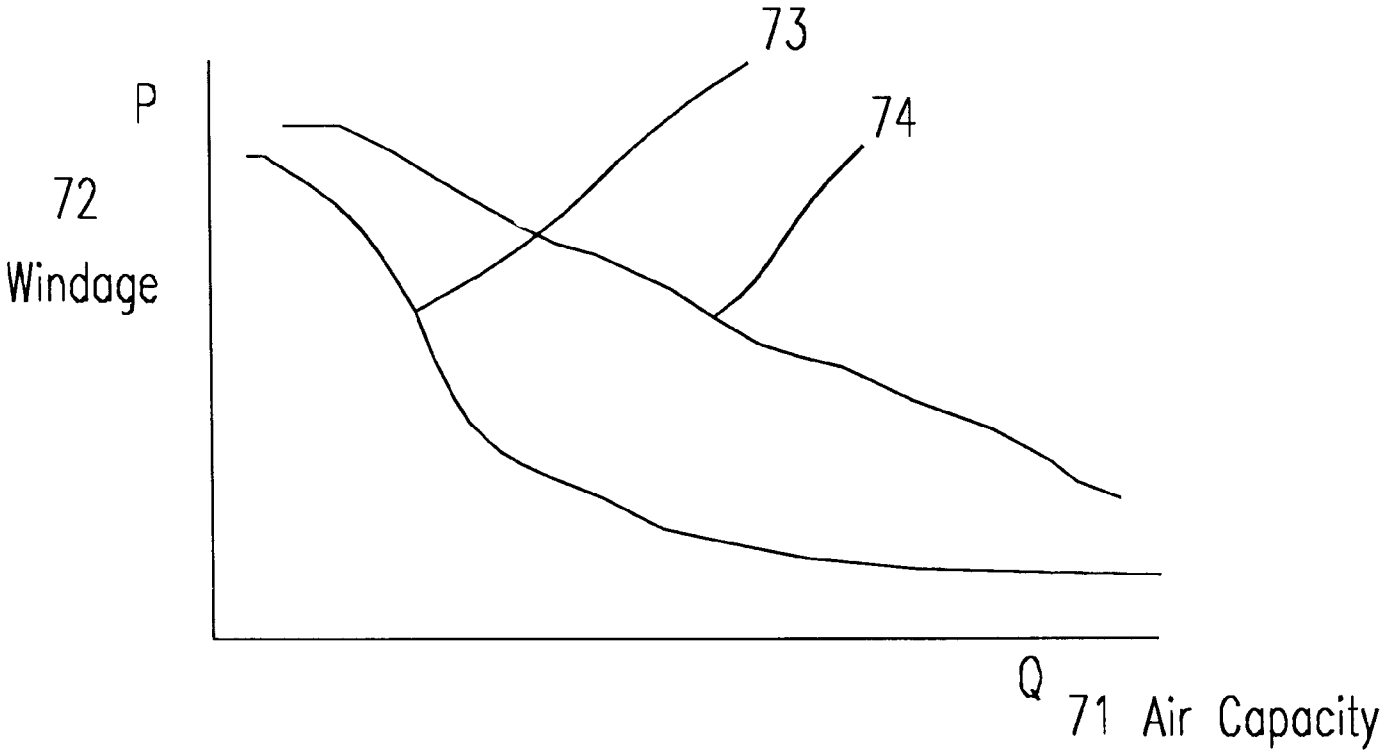
FIG. 7 is a characteristic curve of an exemplary embodiment of the centrifugal fan of the present invention, in comparison with a conventional axial flow fan.

Please refer to FIG. 7. As can be seen from FIG. 7, the axial flow fan curve 73 will have a relatively high air capacity 71 as the windage 72 is low. However, if the windage 72 is risen up to a certain degree, the axial flow fan will be much likely to be stalled, which will lead to a low heat-dissipating efficiency and a high noise.

On the contrary, it can be seen from the centrifugal fan curve 74 of the present invention that the centrifugal fan of the present invention will be more unlikely to be stalled as the windage 72 is raised. Thus, the working range of the centrifugal fan is enlarged and the heat-dissipating efficiency is much better than that of the axial flow fan.

In summary, the centrifugal fan of the present invention has the following three advantages:

(a) The outlet opening of the centrifugal fan is horn-shaped for increasing the air outflow.

(b) The impeller of the centrifugal fan has a reduced diameter and bared inner space such that the fan blades attached to the impeller are protruded from the rim of the impeller for increasing the air capacity.

(c) each of the fan blades is chipped at the rim, and the gap of the fan blade is near the intake opening of the casing for lowering noise.

Those of skill in the art will recognize that these and other modifications can be made within the spirit and scope of the invention as defined in the appended claims.

We claim:

1. A centrifugal fan for use in cooling a laptop computer comprising:

a casing having an intake opening and an outlet opening; and, an impeller rotatably mounted in said casing, the impeller having a base and plural fan blades arranged and disposed on a periphery of an upper surface of said base to define a space at a central portion of said base for increasing intake airflow capacity and heat dissipation, said plural fan blades partially-protruding from an edge of said base, each of said plural fan blades being chipped in an outer edge thereof to form a gap in a rim thereof, said gap of each said fan blade being within said intake opening of said casing for reducing noise.

2. The centrifugal fan according to claim 1, wherein said outlet opening is reduced in an inner diameter thereof from an outlet toward an inner space of said casing.

3. A centrifugal fan for use in cooling a laptop computer comprising:

a casing having an intake opening and an outlet opening; and an impeller rotatably mounted in said casing, the impeller having a base and plural fan blades arranged and disposed on a periphery of an upper surface of said base to define a space at a central portion of said base for increasing intake airflow capacity and heat dissipation, each of said plural fan blades having a gap in a rim thereof for reducing noise.

4. The centrifugal fan according to claim 3, wherein said outlet opening is gradually reduced in an inner diameter from an outlet thereof toward an inner space of said casing.

5. The centrifugal fan according to claim 3, wherein said plural fan blades are partially protruded from an edge of said base.

6. The centrifugal fan according to claim 3, wherein said gap of each said fan blade is near said intake opening of said casing.

* * * * *